US005232575A

United States Patent [19]

Dodd

[11] Patent Number: 5,232,575

[45] Date of Patent: Aug. 3, 1993

[54] POLYMERIC LEVELING ADDITIVE FOR ACID ELECTROPLATING BATHS

[75] Inventor: John R. Dodd, Wilmington, Del.

[73] Assignee: McGean-Rohco, Inc., Cleveland, Ohio

[21] Appl. No.: 705,748

[22] Filed: May 31, 1991

Related U.S. Application Data

[63] Continuation-in-part of Ser. No. 649,357, Feb. 1, 1991, abandoned, which is a continuation-in-part of Ser. No. 558,347, Jul. 26, 1990, abandoned.

[51] Int. Cl.[5] ..... C25D 3/00; C25D 3/38; C25D 3/58

[52] U.S. Cl. ..... 205/238; 205/261; 205/239; 205/296

[58] Field of Search ..... 205/296, 297, 239, 312, 205/302, 299, 290, 281, 279, 270, 269, 267, 264, 263, 261, 238; 106/1.18, 1.23, 1.26

[56] References Cited

U.S. PATENT DOCUMENTS

| | | | |
|---|---|---|---|
| 3,502,551 | 3/1970 | Todt et al. | 205/296 |
| 3,659,915 | 3/1972 | Quimby et al. | 205/296 |
| 3,704,213 | 11/1972 | Fournier et al. | 205/296 |
| 3,869,358 | 3/1975 | Nobel et al. | 205/308 |
| 4,376,685 | 3/1983 | Watson | 205/296 |
| 4,555,315 | 11/1985 | Barbieri et al. | 205/296 |
| 4,667,049 | 5/1987 | Heikkila et al. | 205/296 |

*Primary Examiner*—John Niebling
*Assistant Examiner*—Brian M. Bolam
*Attorney, Agent, or Firm*—William P. Hauser; James A. Lucas

[57] ABSTRACT

Acid, electroplating baths having consistent leveler activity contain levelers which are quaternized near-monodisperse polymers of acrylic or methacrylic trialkyl amine esters. The polymers may contain hydroxyalkyl acrylate or methacrylate ester components, unquaternized acrylic or methacrylic amine component as well as other polymeric components.

23 Claims, No Drawings

POLYMERIC LEVELING ADDITIVE FOR ACID ELECTROPLATING BATHS

RELATED PATENT APPLICATION

The present patent application is a continuation-in-part of Ser. No. 07/649,357, filed Feb. 1, 1991, now abandoned which is a continuation-in-part of Ser. No. 07/558,347, filed Jul. 26, 1990 now abandoned.

BACKGROUND OF THE INVENTION

This invention relates to the electrodeposition of a metal, preferably copper, from aqueous acidic baths. More particularly this invention relates to an aqueous acidic bath for the electrodeposition of copper containing additives which provide leveled copper electrodeposits. Still more particularly this invention relates to the use of such baths to produce printed circuit boards.

A large number of agents have been described in the art for use in electroplating baths alone or in combination to improve the quality of the electrodeposit in terms of brightness, surface smoothness, hardening, leveling and to increase the lower limiting current density of deposition. The use of such agents in aqueous, acidic, copper plating baths for the preparation of printed circuits is described in Chapter 7 of the "Printed Circuits Handbook", Second Edition, 1979, McGraw-Hill Book Company, edited by Clyde F. Coombs, Jr., and in particular Sections 18 and 19. In Section 18, Coombs indicates that additives to acid copper sulfate plating baths can be effective in grain refinement, leveling, and hardening and as a brightener or a means of increasing the current density range. The term "leveled" denotes a copper deposit whose surface is smoother than its substrate. The term "bright" indicates that the formed electrodeposit is characterized by having a highly reflective surface gloss over most of its surface. Generally leveling and brightness vary with the current density at the cathode, all other factors such as copper salt concentration, pH, type of acid, temperature etc. being equal. As the current density decreases brightness of the electrodeposit tends to decrease often diminishing to a haze. The strength of leveling also varies with current density. Coombs indicates that such additives include glue, peptone, resorcinol, thiourea, molasses, gum Arabic as well as proprietary compositions.

A variety of brightening and leveling additives are disclosed in U.S. Pat. Nos. 3,502,551; 4,376,685 and 4,555,315 and the patents cited therein.

U.S. Pat. No. 3,502,551 discloses the use of polyvinyl amines in acid copper baths with oxygen-containing high-molecular compounds and organic thio compounds to obtain high-gloss copper precipitates with increased leveling effect.

U.S. Pat. No. 4,376,685 discloses acid copper electroplating baths containing as brightening and leveling additives an alkylated polyalkyleneimine obtained as a reaction product of a polyalkyleneimine with an epihalohydrin and an alkylating agent; an organic sulfosulfonate; a polyether and optionally a thioorganic compound.

U.S. Pat. No. 4,555,315 discloses copper plating baths for high speed electroplating wherein the bath contains as essential additives a polyether compound; an organic divalent sulfur compound, a reaction product of polyethyleneimine and an alkylating agent; and a partial adduct of a tertiary alkyl amine with polyepichlorohydrin to form a polyquaternary amine.

Although existing additives are useful in acid copper electroplating baths, leveler compositions are complex reaction products whose constitution and activity may vary from batch to batch. Consequently, there is a need in the printed circuit plating industry for leveler additives with consistent activity.

SUMMARY OF THE INVENTION

The need for consistent leveler activity in acid electroplating baths is met by the use of the quaternized, near-monodisperse, acrylic, polymeric amine levelers of this invention. The plating bath leveler is a polymer having a first quaternized amine component of the structure:

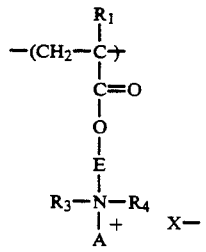

(Formula I)

wherein $R_1$ is hydrogen or methyl; E is an alkylene group having 1 to 6 carbon atoms; $R_3$ and $R_4$ independently are alkyl groups having 1 to 4 carbon atoms; A is the residue of an alkylating agent; X—is an anion; wherein the ratio of the weight average molecular weight ($\overline{M}w$) of the polymer to the number average molecular weight ($\overline{M}n$) of the polymer is about 5 or lower. In a further embodiment the polymer can optionally contain a component of the structure:

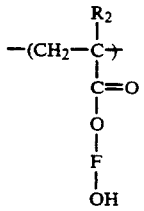

(Formula II)

wherein $R_2$ is hydrogen or methyl; and F is an alkylene group having 1 to 6 carbon atoms.

Thus, an aqueous electroplating bath of this invention contains at least one polymer having a quaternized amine component of the structure:

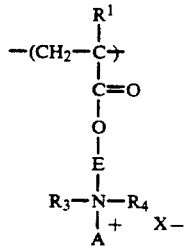

and optionally a second component of the structure:

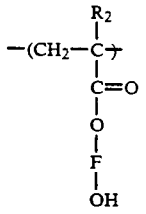

wherein $R_1$ and $R_2$ independently are hydrogen or methyl; E is an alkylene group having 1 to 6 carbon atoms; F is an alkylene group having 1 to 6 carbons atoms; $R_3$ and $R_4$ independently are alkyl groups having 1 to 4 carbon atoms; A is the residue of an alkylating agent; X—is an anion; wherein the mole percentage in the polymer of the first quaternized amine component ranges from 100% to 25%; and the mole percentage in the polymer of the second component ranges from 0% to 75% and wherein the ratio of the weight average molecular weight ($\overline{M}w$) of the polymer to the number average molecular weight ($\overline{M}n$) of the polymer is about 5 or lower.

DETAILED DESCRIPTION OF THE INVENTION

The improved acid electroplating baths of this invention have consistent leveler activity. In addition to the polymeric leveler of this invention, the bath contains typical acid copper plating components as well as other conventional additives. The leveler of this invention is a quaternized near-monodisperse polymer of acrylic or methacrylic trialkyl amine ester in which the quaternization may be substantially complete. The polymer contains at least a first quaternized (meth)acrylic amine component and may contain a second (meth)acrylic, hydroxy component as well as optional, conventional components.

The first quaternized (meth)acrylic amine component has the structure:

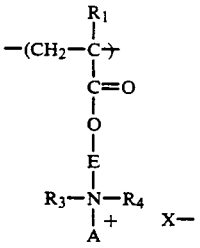

(Formula I)

wherein $R_1$ is hydrogen or methyl; E is an alkylene group having 1 to 6 carbon atoms; $R_3$ and $R_4$ independently are alkyl groups having 1 to 4 carbon atoms; A is the residue of an alkylating agent; and X—is an anion. The residue of the alkylating agent may be an aryl group, an alkyl group having 1 to 10 carbon atoms, an allyl group, or combination thereof. Preferred alkylating agents are benzyl halide, allyl halide, propane sultone and dimethyl sulfate wherein chloride is the preferred halide. The alkyl and alkylene groups may be normal or branched or in some instances cyclic groups or alkyl and/or alkylene groups may be joined to form a heterocyclic ring. Preferably, alkylene groups are normal. Typically, the mole percentage of the first quaternized (meth)acrylic amine component ranges from 100% to 25% and preferably from 100% to 50%.

The first quaternized (meth)acrylic amine component may contain up to about 80 mole % of unquaternized (meth)acrylic amine having the structure:

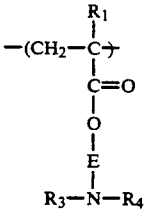

wherein $R_1$, $R_3$, R4 and E are the same as designated for the quaternized (meth)acrylic amine. To achieve 100% quaternization of the (meth)acrylic amine, excess alkylating agent is typically required. Since some alkylating agents possess toxic or other undesirable environmental characteristics, the (meth)acrylic amine may be alkylated with slightly less than the stoichiometric amount needed for 100% alkylation in order to prevent or substantially reduce the presence of residual alkylating agent in the quaternized (meth)acrylic amine component. For this purpose, the quaternized (meth)acrylic amine component may contain up to about 10 mole % of the unquaternized (meth)acrylic amine, preferably for this purpose, the unquaternized amine is present at concentrations of up to about 6 mole %. This component having slightly reduced alkylation is substantially equivalent to the 100% alkylated component.

The polymeric amine leveler of this invention which contains substantially no unquaternized (meth)acrylic amine, has been found to possess exceptionally high leveling activity. Consequently, only very small amounts are required to meet the optimum leveling needed in most electroplating baths. The ability to maintain constant leveling activity during the electroplating process can be hampered by these very low leveler concentrations which can be at, or beyond, the limit of detectability of monitoring equipment. It has been found that the activity of the polymeric amine levelers of this invention may be adjusted to and maintained at a suitable measurable value by decreasing the extent of alkylation of the polymeric amine component. Thus, the first quaternized (meth)acrylic amine component of the leveler of this invention, may contain up to about 80 mole %, or more, of unquaternized (meth)acrylic amine component and still produce satisfactory, measurable leveling activity in electroplating baths. Although the percentage of unquaternized (meth)acrylic amine component will depend on the nature of the electroplating bath and monitoring equipment used, polymeric amine levelers containing up to about 50 mole % of unquaternized (meth)acrylic amine component are particularly useful. Polymeric amine levelers containing between about 60 mole % and about 10 mole % of unquaternized (meth)acrylic amine component are particularly preferred.

The second (meth)acrylic hydroxy component has the structure:

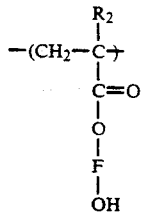

(Formula II)

wherein $R_2$ is hydrogen or methyl and F is an alkylene group having 1 to 6 carbon atoms. The alkylene group may be normal, branched or in some instances cyclic. Typically, the alkylene group is normal. Typically, the mole percentage of the second (meth)acrylic hydroxy component ranges from 0% to 75% and preferably from 0% to 50%.

The polymer may also contain one or more additional polymeric components which do not interfere with the leveling function of the additive. The additional polymeric component may be present in the polymer in amounts from 0 to 50 mole % and include vinyl compounds, styrenes, acrylics such as alkyl esters, amides and nitriles of acrylic and methacrylic acids, and the like.

The term "monodisperse" indicates that the polymer has a narrow molecular weight distribution so that the ratio of the weight average molecular weight ($\overline{M}w$) of the polymer to the number average molecular weight ($\overline{M}n$) of the polymer is 1. This ratio of $\overline{M}w/\overline{M}n$ for a polymer is termed the "polydispersity" of the polymer. The near-monodisperse polymeric levelers of this invention have a polydispersity of less than about 5 and preferably less than 3.

Of the numerous embodiments of the polymeric levelers of this invention, preferred are poly[N,N-dimethyl-N-benzyl-N-(2-methacryloxyethyl) ammonium chloride] and poly[N,N-dimethyl-N-benzyl-N-(2-methacryloxyethyl) ammonium chlorida-co-2-hydroxyethyl methacrylate].

Although the polymeric leveler may be prepared directly from the quaternized (meth)acrylic amine monomer, it is typically prepared first as a polymeric amine which is then conventionally treated with an alkylating agent, e.g., benzyl chloride, to form the fully or near fully quaternized polymeric leveler. The preferred process for preparing the polymeric amine may be outlined as follows:

POLYMERIZATION ALKYLATION

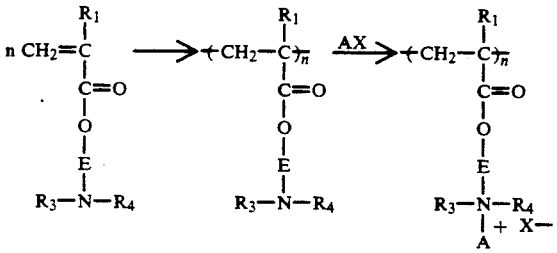

As discussed supra, since some alkylating agents possess undesirable characteristics, the polymeric amine may be alkylated with slightly less than the stoichiometric amount needed for 100% alkylation in order to prevent or substantially reduce the presence of residual alkylating agent in the quaternized (meth)acrylic amine component.

The polymeric amine may be prepared from suitable acrylic monomers by any conventional method. However the polymers are most advantageously produced by a polymerization reaction such as group transfer polymerization described in U.S. Pat. No. 4,417,034, free radical polymerization or other polymerization methods such as anionic polymerization. Group transfer polymerization produces highly reproducible nearly monodisperse (polydispersity less than 1.75) materials and thus generally leads to better control of the resulting leveler activity than materials produced by other polymerization procedures. Group transfer polymerization is particularly adapted to the polymerization of methacrylate and acrylate monomers which, as previously discussed, yield polymers of suitable properties. The molecular weight of the polymer is dependent on the ratio of monomer to initiator. Polydispersity is predominantly dependent on the polymerization conditions. Methods for controlling polydispersity in group transfer polymerization are disclosed in I. B. Dicker et al., Polym. Prepr., *Am. Chem. Soc. Div. Polym. Chem.*, 1987, 28(1), 106. The polydispersity of the quaternized polymeric leveler is advantageously determined from the measured polydispersity of the polymeric amine.

The polymeric leveler of this invention is added to the acid plating baths in amounts of 0.01 ppm to 10 ppm by weight of the plating bath. Preferably 0.1 ppm to 2 ppm are used. Typically, only one polymeric leveler is used in the plating bath. However, two or more polymeric levelers of this invention may be used in combination to obtain the desired leveling activity. In those instances, the polymeric leveler may differ in molecular weight or in polymeric component constitution within the scope of the structures above. In this way, the leveler activity may be tuned to the desired electroplating conditions.

The polymeric levelers of this invention may be used in any acid electroplating bath. Typical acid plating baths used to manufacture printed circuits are the copper sulfate and copper fluoroborate baths disclosed in Coombs Supra. In addition to the polymeric levelers, the acid plating bath typically will contain other additives such as the brighteners, polyethers, and other oxygen-containing high-molecular weight compounds such as disclosed in U.S. Pat. Nos. 3,502,551; 4,376,685; 4,667,049 and 4,555,315 which are incorporated herein by reference.

The effectiveness of the polymeric leveler in an acid electroplating is determined by profilometry of a standard roughness coupon wherein roughness is measured before and after plating at standard conditions and the percentage change in roughness is a measure of the effectiveness of the leveling activity. The effectiveness of a particular leveler in a plating bath is determined by comparing the percentage change in roughness using the plating bath without the leveler to the percentage change in roughness using the plating bath with the leveler.

The polymeric levelers of this invention while being particularly useful in the aqueous, acid, copper, electroplating baths described herein, may also be used in alkaline electroplating baths as well as in baths for electrodepositing other metals such as gold, silver, tin, nickel, chromium and the like.

To further illustrate the present invention the following examples are provided wherein the component portions of polymers are given in mole % unless otherwise designated.

EXAMPLE 1

The preparation of quaternized poly(DMAEMA), the homopolymer poly[N,N-dimethyl-N-benzyl-N-(2-methacryloxyethyl)ammonium chloride] was prepared using the following procedure.

Preparation of poly[2-dimethylaminoethyl methacrylate]: 250.0 gm toluene and 2.3 gm p-xylene were added to a one liter flask which was equipped with a mechanical stirrer, thermometer, nitrogen inlet, drying tube outlet and addition funnels. 0.4 ml of a 1.0 M solution of the catalyst tetrabutyl ammonium m-chlorobenzoate in acetonitrile was then added to the mixture. 11.58 gm of the initiator 1-(2-trimethylsiloxyethoxy)-1-trimethylsiloxy-2-methyl propene was injected into the mixture. At 0.0 minutes a solution of 0.2 ml tetrabutyl ammonium m-chlorobenzoate in 4.04 gm of tetrahydrofuran was fed into the mixture over 123 minutes and at 0.0 minutes 250.0 gm of dimethylaminoethyl methacrylate (DMAEMA) was fed into the mixture over 39 minutes. At 140 minutes the reaction was quenched with 40 gm isopropanol, 7.6 gm water, 18.5 gm methanol and 0.06 gm of dichloroacetic acid. The reaction mixture was then refluxed for 2 hours. 146.0 gm of solvent was distilled from the mixture until the pot temperature equaled aproximately 106° C. to produce a polymer having a $\overline{M}n$ of 3000 and having one hydroxyl group at the end of the chain.

The polymer was then end-capped by reacting the terminal hydroxy group with an isocyanate containing alpha methyl styrene compound by the following procedure: 20.1 gm of 1-(m-isopropenylphenyl)-1-methyl1-ethyl isocyanate [TMI, an isocyanate-functional styrene obtained from American Cyanamide], 0.34 gm of dibutyltin dilaurate (100%), and 0.05 gm of di-t-butylcatechol (10% in toluene) was added to the resulting polymer mixture which was then refluxed for 40 minutes and then quenched with 2.5 gm methanol and refluxed for 30 additional minutes. The reaction was monitored by IR. A 52% solids mixture was produced containing the poly[2-dimethylaminoethyl methacrylate]. The solvent was removed from the mixture in vacuo on a rotary evaporator to produce the solvent free polymer. The polymeric amine had a number average molecular weight of 2640 and a weight average molecular weight of 3250 to give a polydispersity of 1.23.

Alkylation of poly[2-dimethylaminoethyl methacrylate] : A solution of 30 gm of the poly[2-dimethylaminoethyl methacrylate] in 300 ml of methanol and 300 ml of acetonitrile was treated with 60 ml of benzyl chloride and stirred at reflux for 16 hours. The product was precipitated in ether, and then reprecipitated twice from methanol with ether to give 37 gm of poly[N,N-dimethyl-N-benzyl-N-(2-methacryl-oxyethyl)ammonium chloride] which is identified hereinafter as Leveler I.

The Leveler I obtained was characterized by the $^1$H-NMR spectrum (300 MHz, δ in ppm, methanol-$d_4$): 1.1(3H,C—$CH_3$), 2.0(2H,C—$CH_2$-C), 3.2(6H,$NCH_3$), 4.0(2H,$NCH_2$), 4.6(2H,$OCH_2$), 4.6(2H,Ar$CH_2$N), 7.5(3H,ArH), 7.7(2H,ArH). Leveler I had a calculated number average molecular weight of 4766 and a polydispersity of 1.23.

EXAMPLE 2

The preparation of quaternized poly(DMAEMA/-HEMA), the copolymer poly[N,N-dimethyl-N-benzyl-N-(2-methacryl-oxyethyl)ammonium chloride-co-2-hydroxyethyl methacrylate][60/40], was prepared using the following procedure. Preparation of poly[2-hydroxyethyl methacrylate-co-2-dimethylaminoethyl methacrylate]: 2-Dimethylamino-ethyl methacrylate and 2-trimethylsiloxyethyl methacrylate were dried by passage over columns of basic alumina under argon atmosphere. To a stirred solution of 0.4143 gm (0.48 ml, 1.5 mmol) of 1-(2-trimethyl-siloxyethoxy)-1-trimethylsiloxy-2-methyl-1-propene and 200 microliters of tetrabutylammonium biacetate hexahydrate (0.4 M in tetrahydrofuran) in 40 ml of tetrahydrofuran was added a mixture of 9.43 gm (10.1 ml, 60 mmol) of 2-dimethylaminoethyl methacrylate and 8.09 gm (8.13 ml, 40 mmol) of 2-trimethylsiloxyethyl methacrylate at such a rate that the temperature did not exceed 48° C. $^1$H-NMR analysis of an aliquot of the reaction mixture showed no residual monomers. The solvent was removed under reduced pressure. Analysis of a sample of the residue of poly[2-dimethylaminoethyl methacrylate-co-2-trimethylsiloxyethyl methacrylate] by gel permeation chromatography (GPC) showed that the copolymer had a number average molecular weight of 7410 and a weight average molecular weight of 37,000 to give an apparent polydispersity of 5.0. The unexpectedly high measured polydispersity is believed to have resulted from incidental partial deprotection of the polymer hydroxy groups prior to the polydispersity determination. Since polymers prepared using this group transfer polymerization process typically have a polydispersity less than 1.75, the polydispersity of the prepared polymer is believed to be substantially lower than 5.

The poly[2-dimethylaminoethyl methacrylate-co-2-trimethylsiloxyethyl methacrylate] was dissolved in a mixture of 120 ml of tetrahydrofuran, 30 ml of methanol, and 2 ml of tetrabutylammonium fluoride (1 M in tetrahydrofuran), and the solution was stirred for 3.5 hours. The solution was concentrated under reduced pressure and precipitation in ether gave 11.5 gm of poly[2-dimethylaminoethyl methacrylate-co-2-hydroxyethyl methacrylate].

A solution of the poly[2-dimethylaminoethyl methacrylate-co-2-hydroxyethyl methacrylate] in 200 ml of methanol-acetonitrile (1:1 v/v) was treated with 16.6 ml (144 mmol) of benzyl chloride, and stirred at reflux for 24 hours. The solution was concentrated to 75 ml under reduced pressure, and the polymer was precipitated in ether. Two additional precipitations from methanol into ether gave 15.2 gm of poly[N,N-dimethyl-N-benzyl-N-(2-methacryloxyethyl)ammonium chloride-co 2-hydroxyethyl methacrylate][60/40] hereinafter identified as Leveler II. Analysis for $(C_6H_{10}O_3)_4(C_{15}H_{22}O_2NCl)6.10H_2O$:

| | | | | | |
|---|---|---|---|---|---|
| Calculated was: | C, 56.97; | H, 8.05; | N, 3.50; | Cl, 8.85. | |
| Measured was: | C, 57.19; | H, 8.29; | N, 3.22; | Cl, 8.50. | |

Leveler II had a calculated number average molecular weight of 9400 and an apparent polydispersity of 5.

EXAMPLE 3

An acid copper plating bath (1.7 liter) was equipped with copper anodes, air sparge, and an additive feed system. The plating bath had the following composition:

| | |
|---|---|
| Copper Sulfate ($CuSO_4.5H_2O$) | 75 g/liter |
| Concentrated Sulfuric Acid | 200 g/liter |
| Chloride Ion | 25 ppm |

there were added as primary brighteners and luster formers (without a leveler additive) the following:

| | |
|---|---|
| (1) N,N-Dimethylamino-thioxomethyl-thiopropanesulfonate Sodium Salt | 5.6 mg/liter (at startup) 0.15 mg/liter (working level) |

(2) Polyethyleneglycol ($\overline{M}W$ =8000) 0.3 g/liter Initial plating (termed dummy plating) was carried out on copper laminate at 12 ASF until the level of (1) in the plating bath had dropped from the startup level to the working level. At this time, the additive feed of components (1) and (2) was started, and the plating current density was increased to 20 ASF. The initial plating on copper laminate was continued with additive feed rate adjustment until a steady-state [1]=0.15 mg/liter was attained and bright, uniform copper was being plated.

The relative degree of leveling of a given plating bath was determined by profilometry of a standard roughness coupon done both before and after plating at standard conditions (20 ASF, 30 minutes). The standard roughness coupons were obtained from GAR Electroforming Division, Danbury, CT 06810. The plating of a roughness coupon was effected while it was mounted in a stainless steel picture frame bracket used as a current thief. The profilometry measurements were taken on a Dektak profilometer. Two parameters (average roughness and maximum height) were measured, and the percentage change in the parameter after plating versus before plating was determined.

Plating electrolyte containing (1) and (2) and having the composition given above with no added leveler was first tested with the results given in Table 1 as Run A. Next 0.5 ppm of Leveler II (quaternized poly(DMAEMA/HEMA)) was added to the bath without changing the levels of (1) and (2). The results obtained with this bath are given in Table 1 as Run B. After sufficient dummy plating to remove any residual (II), the leveler was again added to the bath at the 0.5 ppm level without changing the levels of (1) and (2). The results obtained with this bath are given in Table 1 as Run C. As the data of Table 1 indicates, both Runs B and C with leveler present afforded substantial leveling while in Run A with no leveler there was little or no leveling.

TABLE 1

Standard Roughness Coupon/Profilometry Results

| Run | Additives Present | Ra (% Chg) | Max Ht (% Chg) |
|---|---|---|---|
| A | 1 + 2 | 2.48 | −4.61 |
| B | 1 + 2 + 0.5 ppm II (initial) | 18.94 | 23.83 |
| C | 1 + 2 + 0.5 ppm II (later) | 31.24 | 40.60 |

Ra (% Chg) = percentage change (decrease) in the average roughness of the plated standard roughness coupon versus that for the coupon before plating.
Max Ht (% Chg) = percentage change (decrease) in the maximum height roughness parameter of the plated standard roughness coupon versus that for the coupon before plating.

EXAMPLE 4

This example employed the same initial plating bath composition and methodology as was given in Example 3. The essential difference is that the leveler tested in this example was Leveler I (quaternized poly(DMAEMA)).

Plating electrolyte containing (1) and (2) and having the composition given above with no added leveler was tested initially with the results given in Table 2 as Run A. Next 0.5 ppm of (I) was added to the bath without changing the levels of (1) and (2). The results obtained with this bath are given in Table 2 as Run B. After sufficient dummy plating to remove any residual (I), the leveler was again added to the bath at the 0.5 ppm level without changing the levels of (1) and (2). The results obtained with this bath are given in Table 2 as Run C. After sufficient dummy plating to remove any residual (I), the leveler was added to the bath at the 1.0 ppm level without changing the levels of (1) and (2). The results obtained with this bath are given in Table 2 as Run D. As the data of Table 2 indicate, Runs B-D with leveler present all afforded substantial leveling, while in Run A with no leveler there was little or no leveling.

TABLE 2

Standard Roughness Coupon/Profilometry Results

| Run | Additives Present | Ra (% Chg) | Max Ht (% Chg) |
|---|---|---|---|
| A | 1 + 2 | 5.42 | 8.20 |
| B | 1 + 2 + 0.5 ppm I (initial) | 20.92 | 29.92 |
| C | 1 + 2 + 0.5 ppm I (later) | 22.02 | 31.89 |
| D | 1 + 2 + 1.0 ppm I | 43.41 | 50.84 |

Ra (% Chg) and Max Ht (% Chg) have the same definition as given in the key of TABLE 1.

EXAMPLE 5

The quaternized poly (DMAEMA/MMA/BMA) (96/2/2, weight %), the terpolymer poly[N,N-dimethyl-N-benzyl-N-(2-methacroyloxy-ethyl) amonium chloride-co-methyl methacrylate-co-butyl methacrylate][96/2/2], was prepared using the following procedure.

A 3-liter flask was equipped with a mechanical stirrer, thermometer, $N_2$ inlet, drying tube outlet, and addition funnels. Tetrahydrofuran, 505.0 gm, was charged to the flask. The catalyst tetrabutyl ammonium m-chlorobenzoate, 0.6 ml of a 1.0 M solution in acetonitrile, was then added. Feed I - dimethylamino-ethyl methacrylate (DMAEMA), 478.0 gm, methyl methacrylate (MMA), 20.8 gm, and butyl methacrylate (BMA), 20.9 gm, was started and added over 30 minutes. At 140 minutes, the reaction was quenched with 310.0 gm of methanol and 250.0 gm of acetonitrile. This generated a 3,000 Mn polymer of DMAEMA/MMA/BMA (92/4/4, weight %).

To quaternize this polymer, the above solution was heated to reflux and the first addition of benzyl chloride, 92.2 gm, was added. The second addition of benzyl chloride, 92.0 gm, was charged 65 minutes after the first. The third addition of 92.2 gm was added 60 minutes after that, the fourth addition of 92.2 gm was added 70 minutes after the third, and the final addition of 91.0 gm was added after another 70 minutes. A total of 458.4 gm of benzyl chloride was added which was about 95 mole % of the stoichiometric amount needed to fully alkylate the polymeric amine. The solution was refluxed for another 60 minutes. This made the quaternized poly(DMAEMA/MMA/BMA) polymer of composition (96/2/2, weight %), a portion of which was obtained as a white amorphous solid upon solvent removal and grinding with a mortar/pestle. This solid leveler was designated as Leveler III and was then tested in the following example.

EXAMPLE 6

The acid copper plating experiment with the Leveler III sample was used similarly to that of Example 3 with the following modifications:

(1) The initial dummy plating of the freshly made bath was carried out using a larger separate plating cell.

(2) Feed components (1) and (2) were added incrementally in small portions to maintain the concentration of (1) at approximately the working level of 0.15 mg/liter rather than continuously pumping the feed into the plating bath (as was carried out in Example 3).

As was carried out in earlier examples, the relative degree of leveling of a given plating bath was determined by profilometry of a standard roughness coupon carried out both before and after plating at standard conditions (20 ASF, 30 minutes). All other details were the same as given in Example 3. Plating electrolyte containing (1) and (2) as in Example 3 with no leveler was tested initially with the results given in Table 3 as Run A. Next 0.5 ppm of solid leveler III (quaternized poly(DMAEMA/MMA/BMA) (96/2/2, weight %) was added to the bath without changing the levels of (1) and (2). The results obtained with this bath are given in Table 3 as Run B. The results obtained with this bath containing 1.0 ppm of solid leveler III are given in Table 3 as Run C. (Between plating runs each bath was discarded and a fresh bath with the designated formulation was prepared.) In Table 3, Ra (% Chg) and Max Ht (% Chg) have the same definition as given in the key of Table 1.

TABLE 3

| Standard Roughness Coupon/Profilometry Results | | | |
|---|---|---|---|
| Run | Additives Present | Ra (% Chg) | Max Ht (% Chg) |
| A | 1 + 2 | 0.16 | 3.83 |
| B | 1 + 1 + 0.5 ppm III | 17.12 | 31.16 |
| C | 1 + 2 + 1.0 ppm III | 19.08 | 23.25 |

As the data of Table 3 indicated, Runs B and C with leveler present, both afforded substantial leveling, while in Run A with no leveler there was little or no leveling.

EXAMPLE 7

Three partially quaternized polymeric amine levelers were prepared containing 25 mole %; 50 mole % and 75 mole % respectively. Each partially quaternized poly(DMAEMA/MMA/BMA) (96/2/2, weight %), the terpolymer poly[N,N-dimethyl-N-benzyl-N-(2-methacryloxyethyl) ammonium chloride-co-methyl methacrylate-co-butyl methacrylate] (96/2/2, weight %), was prepared using the procedure of Example 5 except that quaternization was limited to 25 mole %; 50 mole %; and 75 mole % and were designated Leveler IV; Leveler V; and Leveler VI respectively.

EXAMPLE 8

Acid copper plating experiments with the Leveler IV; Leveler V; and Leveler VI samples were carried out similarly to that of Example 3 with the following modifications:

1) The initial dummy plating of the freshly made bath was carried out using a larger separate plating cell.

2) Each individual plating run was completed within a short time, such that components (1) and (2) were maintained at their proper concentrations without any additions. The working level of component (1) was approximately 0.15 mg/L in all runs.

As was carried out in earlier examples, the relative degree of leveling of a given plating bath was determined by profilometry of a standard roughness coupon carried out both before and after plating at standard conditions (20 ASF, 15 minutes). All other details were the same as given in Example 3. Plating electrolyte containing (1) and (2) as in Example 3 with no leveler was tested initially with the results given in Table 4 as Run A. Next 0.5 ppm of solid leveler IV (25% quaternized poly(DMAEMA/MMA/BMA) (96/2/2, weight was added to a fresh (equal volume) aliquot of broken-in plating bath solution identical to that from Run A and the resulting bath was tested. The results obtained with this bath are given in Table 4 as Run B. Repeating the same procedure for Leveler V and Leveler VI, the results obtained with the baths are given in Table 4 as Run C and Run D respectively. In Table 4, Ra (% Chg) and Max Ht (% Chg) have the same definition as given in the key of Table 1.

TABLE 4

| Standard Roughness Coupon/Profilometry Results | | | |
|---|---|---|---|
| Run | Additives Present | Ra (% Chg) | Max Ht (% Chg) |
| A | 1 + 2 | 2.42 | 6.72 |
| B | 1 + 2 + 0.5 ppm IV | 9.03 | 12.97 |
| C | 1 + 2 + 0.5 ppm V | 12.10 | 17.83 |
| D | 1 + 2 + 0.5 ppm VI | 16.45 | 33.78 |

As the data of Table 4 indicates, Runs B, C and D with partially quaternized leveler present, afforded substantial leveling, while in Run A with no leveler present there was little or no leveling.

EXAMPLE 9

Two quaternized polymeric amine levelers were prepared containing 90 mole % and 100 mole % respectively. Each quaternized poly (DMAEMA/MMA/BMA) (96/2/2, weight %), the terpolymer poly [N,N-dimethyl-N-benzyl-N-(2-methacryloxyethyl) ammonium chloride-co-methyl methacrylate-co-butyl methacrylate] (96/2/2, weight %), was prepared using the procedure of Example 5 except the quaternization was 90 mole %; and 100 mole % and were designated Leveler VII; and Leveler VIII respectively. The intermediate unquaternized poly (DMAEMA/MMA/BMA) (96/2/2, weight %), the terpolymer poly [N,N-dimethyl-N-(2-methacryloxyethyl) amine-co-methyl methacrylate-co-butyl methacrylate] (92/4/4, weight %), i.e. having 0 mole % quaternization, was designated Leveler Z.

EXAMPLE 10

Acid copper plating experiments with the Leveler Z; Leveler V; Leveler VII; and Leveler VIII samples (0%; 50%; 90%; and 100% quaternization, respectively) were carried out in a plating bath similar to that of Example 3 with the following modifications:

1) The initial dummy plating of the freshly made bath was carried out using a larger separate plating cell. 2) Feed components (1) and (2) were added incrementally in small portions to maintain the concentration of (1) at approximately the working level of 0.15 mg/liter rather than continuously pumping the feed into the plating bath (as was carried out in Example 3).

The relative degree of leveling of a given plating bath was determined from thickness measurements of micrographs of plated, printed circuit board cross-sections. A series of identical test panels were prepared from conventional 1 ounce, copper-clad, fiberglass epoxy printed circuit substrates in which the substrate core was about 98 mils (0.098 inch) thick and the copper-cladding on each side is 1.4 mils thick. Each board is drilled with four sets of through-hole arrays with associated tooling holes. Each array consists of 5 parallel rows of through-holes in which the diameter of each through-hole in a row is the same and in which the through-hole diameter of the five rows in 14 mil; 18 mil; 27 mil; 35 mil; and 45 mil. Each board was cross-sectioned along a line defined by the diameters of the four 14 mil through-holes and along a line defined by the diameters of the 27 mil through-holes. Using a 400X optical microscope, micrographs were obtained of the corners where each through-hole intersects the surface of the board. The thickness of plated copper at each corner was measured and divided by the measured thickness of plated copper on the flat surface of the board. The thickness ratios thus obtained for 14 mil diameter through holes were averaged and expressed in Table 5 as a single % change. Similarly, the % change was obtained for the 27 mil diameter through-holes and reported in Table 5. In Table 5 the % change was determined for each leveler at three plating bath concentrations, 0.075 ppm, 0.15 ppm and 0.225 ppm (Runs B through M) and compared to the % change for a plating bath containing no leveler (Run A).

TABLE 5

| % Leveling/Through-Hole Cross-Section Results | | | |
|---|---|---|---|
| Leveler Run | (ppm) | 14 mil Dia. (% Chg) | 27 mil Dia. (% Chg) |
| A | NONE | 7 | 6 |
| | 0% alk. | | |
| B | 0.075 Z | 5 | 3 |
| C | 0.15 Z | 3 | 1 |
| D | 0.225 Z | 0 | 3 |
| | 50% alk. | | |
| E | 0.075 V | 8 | 13 |
| F | 0.15 V | 14 | 23 |
| G | 0.225 V | 21 | 28 |

TABLE 5-continued

| % Leveling/Through-Hole Cross-Section Results | | | |
|---|---|---|---|
| Leveler Run | (ppm) | 14 mil Dia. (% Chg) | 27 mil Dia. (% Chg) |
| | 90% alk. | | |
| H | 0.075 VII | 24 | 26 |
| I | 0.15 VII | 30 | 42 |
| J | 0.225 VII | 38 | 44 |
| | 100% alk. | | |
| K | 0.075 VIII | 33 | 26 |
| L | 0.15 VIII | — | — |
| M | 0.225 VIII | 39 | 41 |

From the date of Table 5, the absence of alkylation, (i.e, 0%) appears to inhibit leveling, but as alkylation of the leveler increases, the % change (i.e. leveling) likewise rapidly rises to a value which appears to approach 50%. The % change using alkylated levelers likewise is increased with increasing concentration in a plating bath.

What is claimed is:

1. An aqueous, electroplating bath containing at least one polymer having a quaternized amine component of the structure:

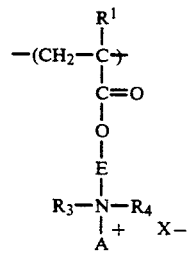

wherein $R_1$ is hydrogen or methyl; E is an alkylene group having 1 to 6 carbon atoms; $R_3$ and $R_4$ independently are alkyl groups having 1 to 4 carbon atoms; A is the residue of an alkylating agent; X—is an anion; wherein the ratio of the weight average molecular weight ($\overline{M}w$) of the polymer to the number average molecular weight ($\overline{M}n$) of the polymer is about 5 or lower.

2. The aqueous, electroplating bath of claim 1 containing at least one polymer having a first quaternized amine component of the structure:

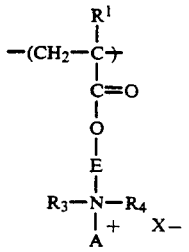

and a second component of the structure:

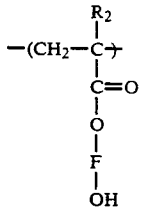

wherein $R_1$ and $R_2$ independently are hydrogen or methyl; E is an alkylene group having 1 to 6 carbon atoms; F is an alkylene group having 1 to 6 carbon atoms; $R_3$ and $R_4$ independently are alkyl groups having 1 to 4 carbon atoms; A is the residue of an alkylating agent; X—is an anion; wherein as the basis of the two components the mole percentage in the polymer of the quaternized amine component ranges from 100% to 25%; and the mole percentage in the polymer of the second component ranges from 0% to 75%.

3. The aqueous electroplating bath of claim 2 wherein the second component is present.

4. The electroplating bath of claim 1 wherein the bath is an aqueous, acid, copper electroplating bath.

5. The aqueous, electroplating bath of claim 1 wherein the ratio of the weight average molecular weight ($\overline{M}w$) of the polymer to the number average molecular weight ($\overline{M}n$) of the polymer is about 3 or lower.

6. The aqueous, electroplating bath of claim 2 wherein the molar percentage of the first quaternized amine component ranges from 100% to 50%; and the molar percentage of the second component ranges from 0% to 50%.

7. The aqueous, electroplating bath of claim 1 wherein the number average molecular weight ($\overline{M}n$) is at least 1000.

8. The aqueous, electroplating bath of claim 1 wherein the alkylating agent is taken from the group consisting of benzyl halide, allyl halide, propane sultone and dimethyl sulfate.

9. The aqueous, electroplating bath of claim 8 wherein the halide is chloride.

10. The aqueous, electroplating bath of claim 1 wherein the polymer contains up to about 50 mole % of an additional component.

11. The aqueous, electroplating bath of claim 10 wherein the additional component is selected from the group consisting of a vinyl compound, styrene, and alkyl ester, amide and nitrile of acrylic or methacrylic

12. The aqueous, electroplating bath of claim 2 wherein the polymer is poly[N,N-dimethyl-N-benzyl-N(2-methacryloxyethyl) ammonium chloride] or poly[N,N-dimethyl-N-benzyl-N-(2-methacryloxyethyl) ammonium chloride-co-2-hydroxyethyl methacrylate].

13. The aqueous, electroplating bath of claim 1 wherein the polymer is added to the electroplating bath in an amount of 0.01 ppm to 10.0 ppm by weight of electroplating bath.

14. The aqueous, electroplating bath of claim 1 wherein the quaternized amine component contains up to about 80 mole % of unquaternized amine having the structure:

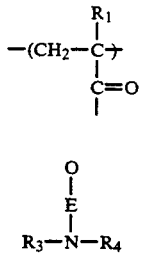

wherein $R_1$, $R_3$, $R_4$, and E are the same as in claim 1.

15. The aqueous, electroplating bath of claim 2 wherein the first quaternized amine component contains up to about 80 mole % of unquaternized amine having the structure:

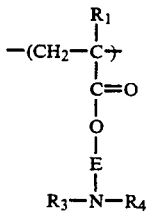

wherein $R_1$, $R_3$, $R_4$ and E are the same as in claim 2.

16. The aqueous, electroplating bath of Claim 14 wherein the quaternized amine component contains up to about 50 mole % of the unquaternized amine.

17. The aqueous, electroplating bath of claim 16 wherein the quaternized amine component contains up to about 10 mole % of the unquaternized amine.

18. The aqueous, electroplating bath of claim 17 wherein the quaternized amine component contains up to about 6 mole % of the unquaternized amine.

19. The aqueous, electroplating bath of claim 14 or claim 15 wherein the quaternized amine component contains between about 60 mole % and about 5 mole % of the unquaternized amine.

20. The aqueous, electroplating bath of claim 1 wherein the polymer is end-capped by reacting a terminal group of the polymer with an isocyanate.

21. The aqueous, electroplating bath of claim 20 wherein the terminal group is hydroxy.

22. The aqueous, electroplating bath of claim 20 wherein the isocyanate contains an alpha methyl styrene compound.

23. The aqueous, electroplating bath of claim 22 wherein the isocyanate is 1-(m-isopropenylphenyl)1-methyl-1-ethyl isocyanate.

* * * * *